US008672508B2

(12) United States Patent
Pearson et al.

(10) Patent No.: US 8,672,508 B2
(45) Date of Patent: Mar. 18, 2014

(54) SCALABLE LED SCONCE LIGHT

(75) Inventors: Dennis Pearson, Foothill Ranch, CA (US); Guang Jin, Santa Monica, CA (US); Jorge Santana, Irvine, CA (US)

(73) Assignee: Tempo Industries, LLC, Irvine, CA (US)

( * ) Notice: Subject to any disclaimer, the term of this patent is extended or adjusted under 35 U.S.C. 154(b) by 190 days.

(21) Appl. No.: 13/448,608

(22) Filed: Apr. 17, 2012

(65) Prior Publication Data

US 2013/0271979 A1 Oct. 17, 2013

(51) Int. Cl.
*F21V 21/00* (2006.01)

(52) U.S. Cl.
USPC ..... 362/249.02; 362/311.02; 362/217.01; 362/217.1; 362/217.14; 362/222

(58) Field of Classification Search
USPC ..... 362/249.01–249.06, 311.02, 223, 362/217.1–217.17, 222, 217.01, 221, 224, 362/361, 351, 374–375
See application file for complete search history.

(56) References Cited

U.S. PATENT DOCUMENTS

| | | | | |
|---|---|---|---|---|
| 7,726,840 | B2 | 6/2010 | Pearson et al. | |
| 8,002,426 | B2 | 8/2011 | Pearson et al. | |
| 8,061,870 | B2 | 11/2011 | Pearson et al. | |
| 8,398,276 | B2 | 3/2013 | Pearson et al. | |
| 8,419,216 | B2 * | 4/2013 | Wu | 362/249.02 |

* cited by examiner

*Primary Examiner* — Robert May
(74) *Attorney, Agent, or Firm* — Greenberg Traurig LLP; Franklin D. Ubell

(57) ABSTRACT

An LED light fixture comprising a contoured light transmissive lens cover pivotally mounted between upper and lower end brackets so as to be movable between an open position and a closed position wherein in the closed position the upper and lower contoured edges of the lens cover mate flushly with the contoured surface of respective upper and lower end caps. A bank of LED carrying housing components are attached between the upper and lower mounting brackets so as to direct illumination toward the lens cover. Expansion brackets may be employed to facilitate addition of one or more additional banks of LED carrying housing components behind a lens cover of longer length to thereby created a sconce fixture of extended length.

6 Claims, 11 Drawing Sheets

SCALABLE LED SCONCE LIGHT

FIELD

The subject disclosure relates to electric lighting fixtures and more specifically to an LED sconce light fixture which is modular and readily adjustable in length.

RELATED ART

Wall sconce light fixtures employing conventional incandescent or fluorescent lamps are widely used, for example, in theatres and hotels.

SUMMARY

The following is a summary description of illustrative embodiments of an LED sconce light fixture. It is provided as a preface to assist those skilled in the art to more rapidly assimilate the detailed design discussion which ensues and is not intended in any way to limit the scope of the claims which are appended hereto in order to particularly point out the invention.

According to one illustrative embodiment, an LED sconce light fixture comprises a contoured light transmissive lens cover, upper and lower end brackets and upper and lower end caps. The end caps each have a flat back and a contoured front surface shaped to match the contour of the contoured lens cover. The lens cover is pivotally mounted so as to be movable between an open position and a closed position wherein, in the closed position, the upper and lower contoured edges of the lens cover mate flushly with the contoured surface of the respective upper and lower end caps. A plurality of rectangular LED housing components, each carrying a circuit board mounting at least one LED, are attached to support members of the upper and lower mounting brackets such that the LED housing components are arrayed so as to direct illumination from the LEDs toward the lens cover.

In one embodiment, the LED housing components may be arrayed in a first bank in a triangular configuration. In one embodiment, the length of the sconce light is expandable by adding a second bank of triangularly arrayed LED lamp housing components. To facilitate this expandable arrangement, a module connector or expansion bracket is provided to which respective lower and upper ends of the first and second bank of LED lamp housing components are attached. By employing a second such expansion bracket, a sconce light embodiment with three vertically disposed banks of LED light housing components may be configured to achieve a still longer sconce light unit.

DETAILED DESCRIPTION

Figure 2:
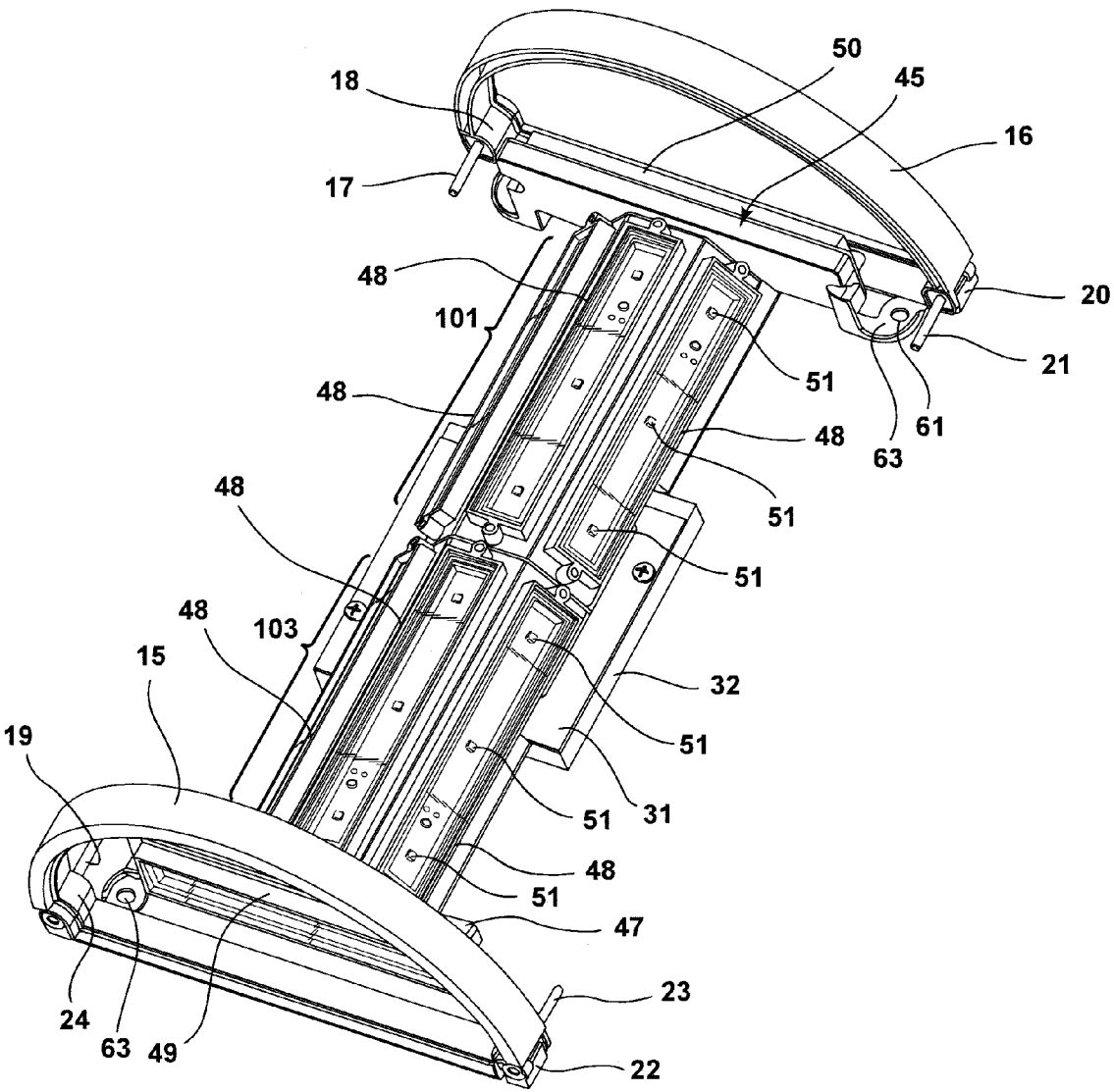
FIG. 2 is a perspective view of the light of FIG. 1 with the lens cover 13 of FIG. 1 removed.
Figure 3:
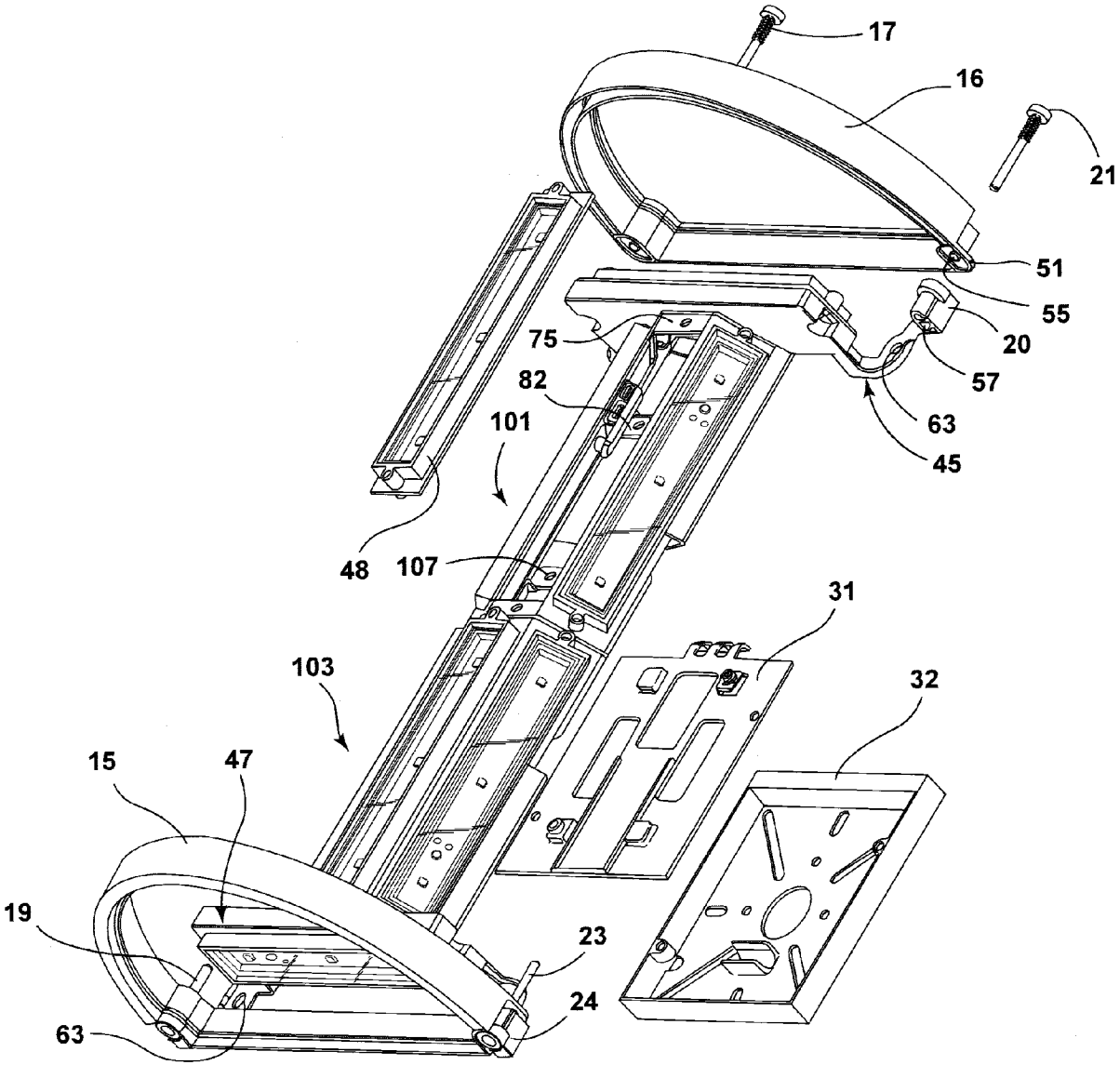
FIG. 3 is an exploded perspective view of the structure of FIG. 2.
Figure 4:
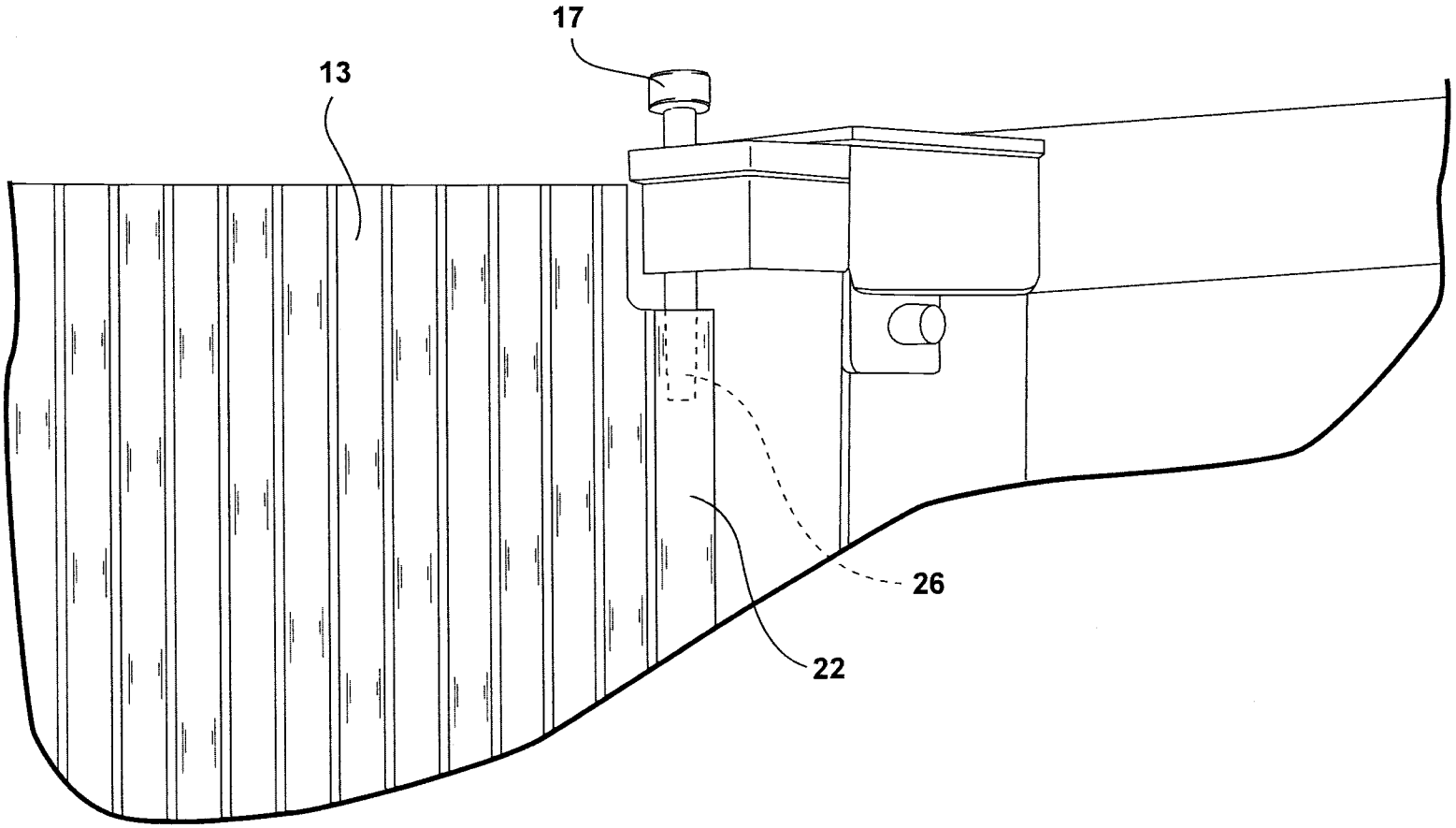
FIG. 4 is a fragmentary view illustrating pivotal attachment of the lens 13 of FIG. 1.

An illustrative LED sconce Light embodiment 11 is illustrated in FIGS. 1-4. The light 11 includes a lens cover 13 of arcuate or semicircular cross-section, which pivotally mounts to first and second end cap components 15, 16. The pivotal attachment may be achieved by screws or bolts 17, 19 (FIG. 2) whose shafts pass through corner mounting blocks 18, 24 of the respective end caps components 15, 16 and enter suitable receptacles or holes, e.g., 26 of circular cross-section, formed along the left edge 22 of the lens cover 13, as illustrated in FIG. 4. The lens 13 may be closed and then held in position by the respective shafts of similar bolts 21, 23, which are inserted through respective corner blocks 20, 22 of the respective end cap components 15, 16 and into an engaging relation with surfaces(s) formed on the right edge of the lens 13.

Figure 1:
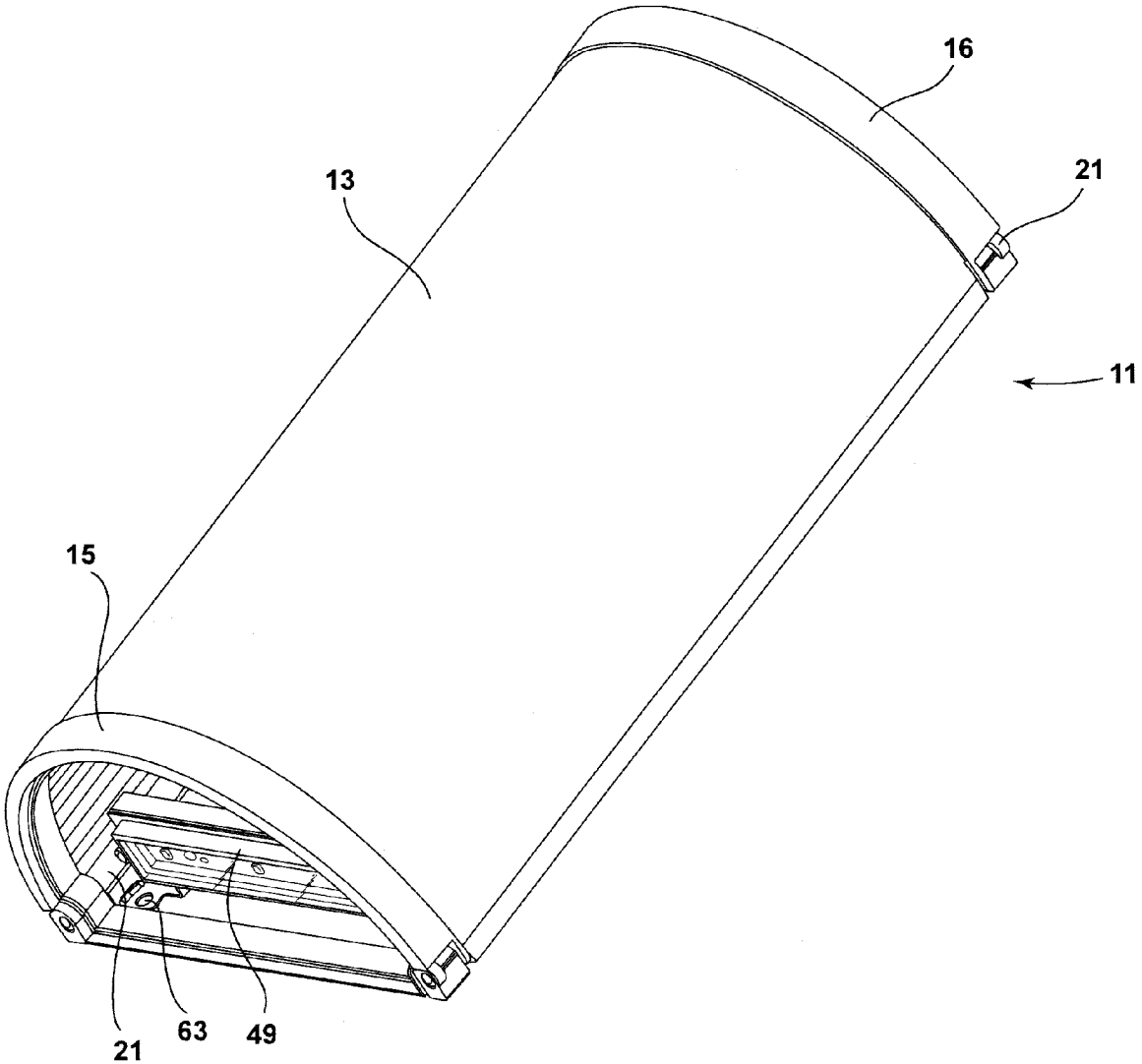
FIG. 1 is a perspective view of an LED sconce light employing two banks of LED lamp housing components according to an illustrative embodiment.
Figure 5:
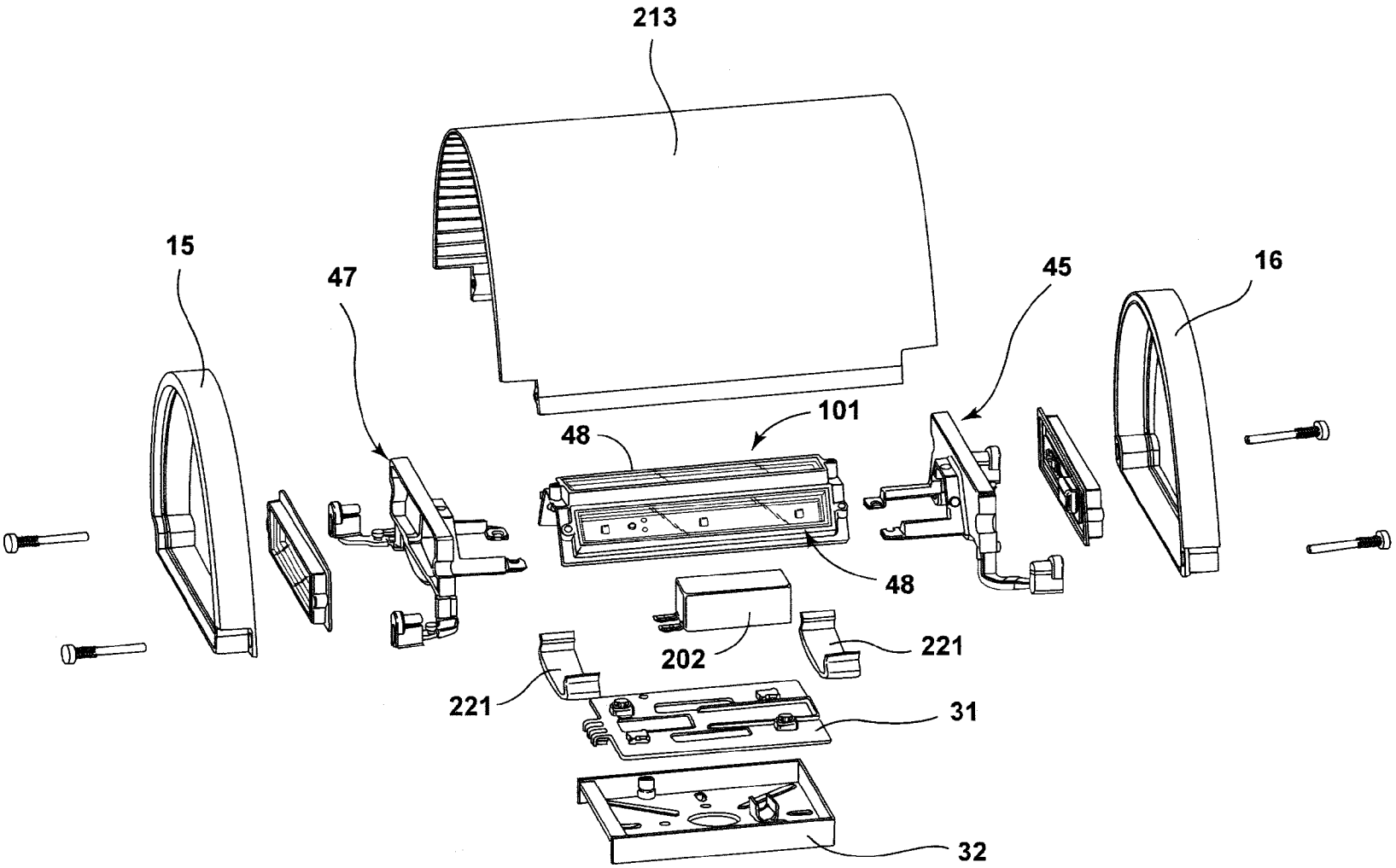
FIG. 5 is an exploded view of an alternate sconce light embodiment employing a single bank of LED lamp housing components.

The embodiment of FIGS. 1-3 further includes a centrally located rectangular junction box mounting bracket 31, which attaches to a rectangular junction box component 32 in a manner to be described further below. In one embodiment, the junction box mounting bracket 31 may be diecast of ZAMAK 3 zinc alloy and may include a built-in level on its back side to assist in insuring proper alignment during installation. In one embodiment, plastic extruded wire covers 221 may be employed and may be formed to snap into the underside of a bank 101 of lamp housing components 48, as shown in FIG. 5.

Figure 11:
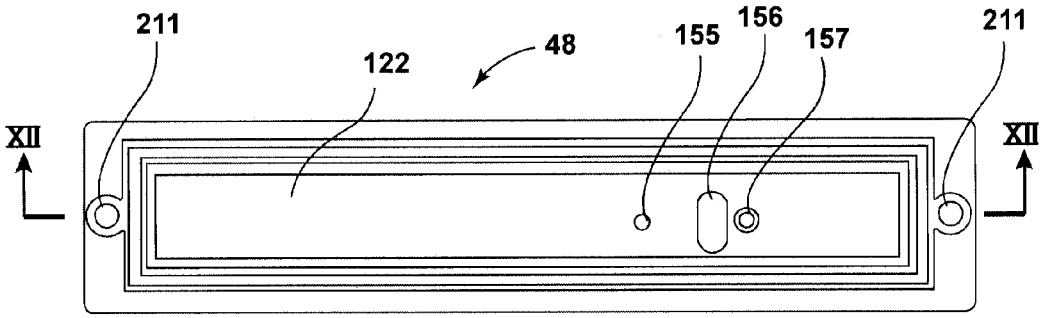
FIG. 11 is a top view of the housing component of FIG. 10.
Figure 12:
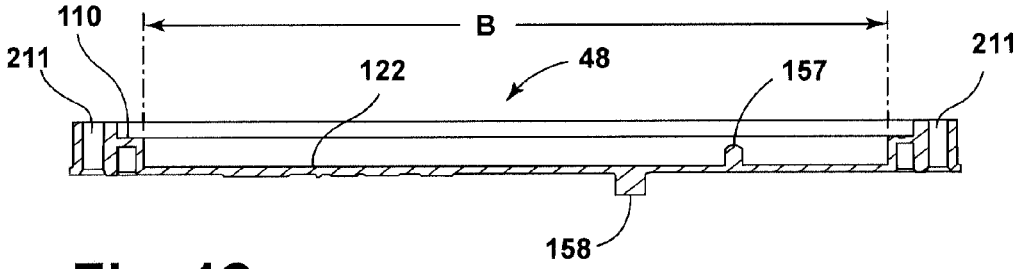
FIG. 12 is a side sectional view of the housing component taken at XII-XII of FIG. 10.
Figure 13:
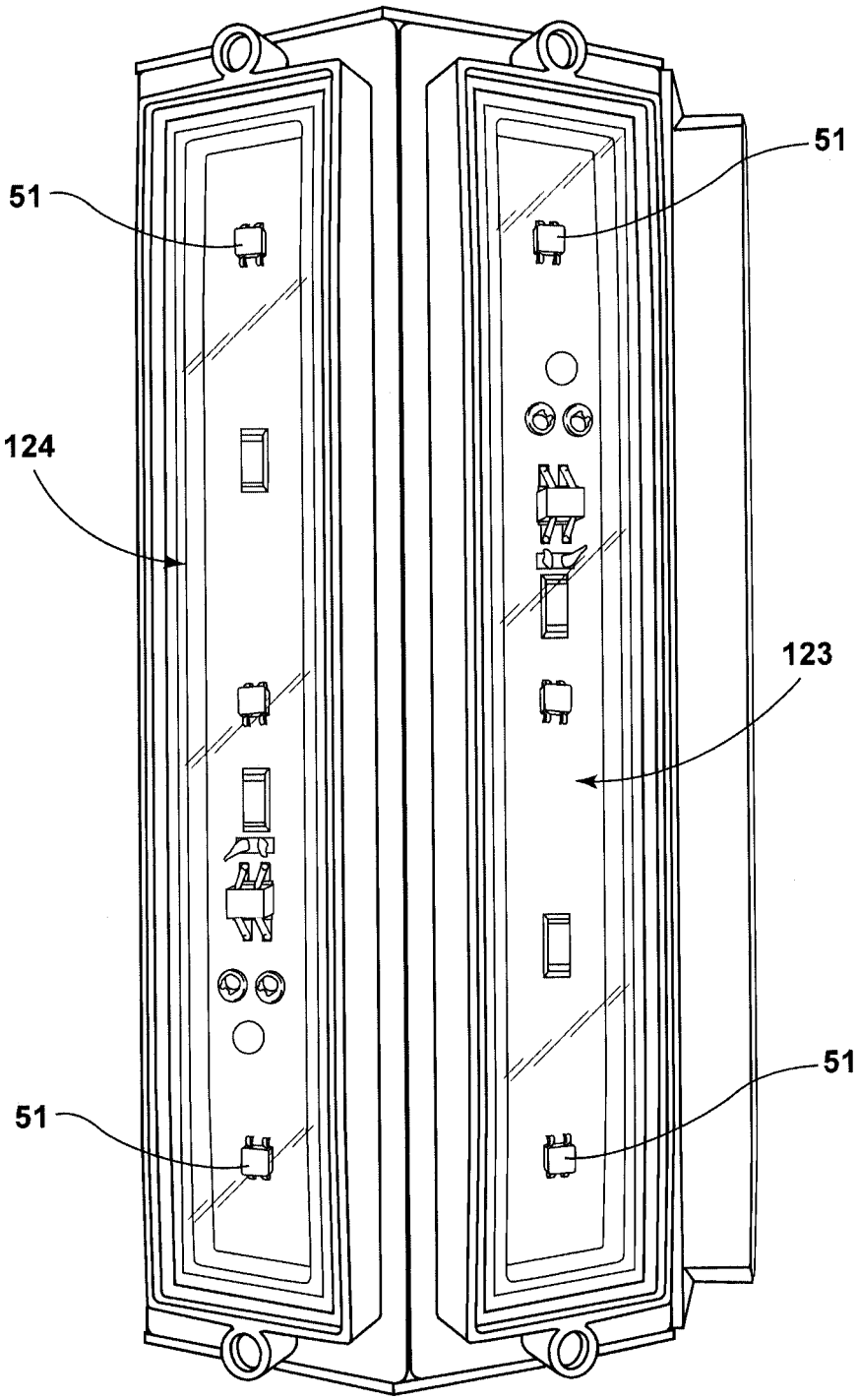
FIG. 13 is a perspective view of an LED circuit board housing component with an LED circuit board in place.

The embodiment of FIGS. 1-4 further includes first and second end brackets 45, 47, discussed in more detail in connection with FIGS. 6 and 7. The first and second end brackets facilitate attachment of a number of rectangular LED housing components 48 and their attendant LED lighting devices, e.g. 51, as well as attachment of "up" and "down" housing components 50, 49, which direct LED light upwardly and downwardly, respectively. In one embodiment, the LED housing components 48, 49, 50 are identical components, each diecast of ZAMAK 3 zinc alloy, but may be fabricated of various other materials. As illustrated in more detail in FIGS. 10-13, each housing component 48 includes a floor 122, which receives a circuit board 123 (FIG. 13) carrying the LED lighting devices 51 and a rectangular well 110, which receives and mounts a lens component 124 carrying the LED lighting devices 51. In one illustrative embodiment, the circuit board is attached to floor 122 using thermal adhesive tape to assist in heat dissipation. In one illustrative embodiment of dimension "B" of FIG. 11, the length of floor 122 may be 4.95 inches.

Figure 8:
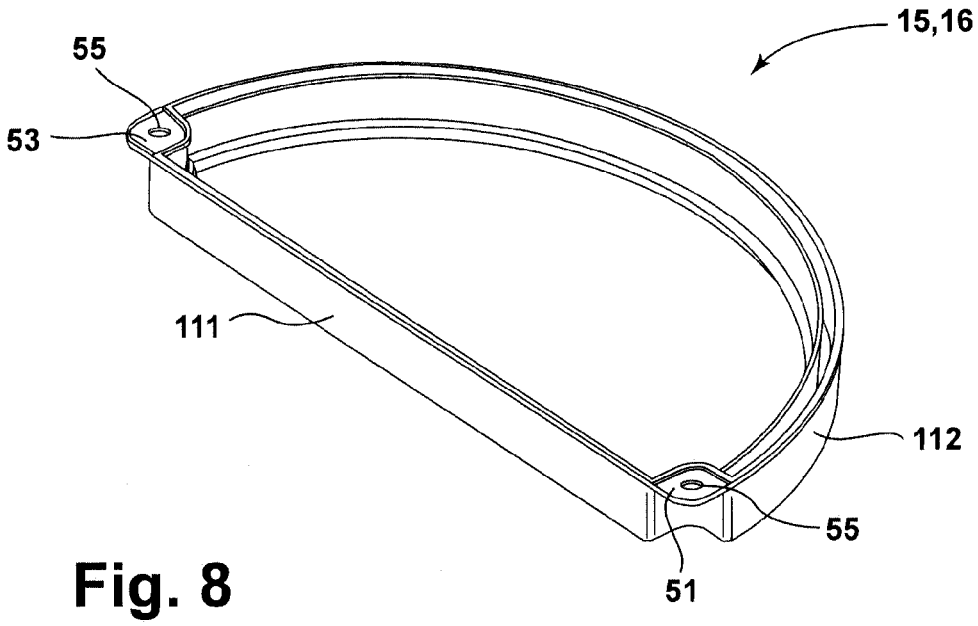
FIG. 8 is a perspective view of an end cap component of the illustrative embodiments.
Figure 9:
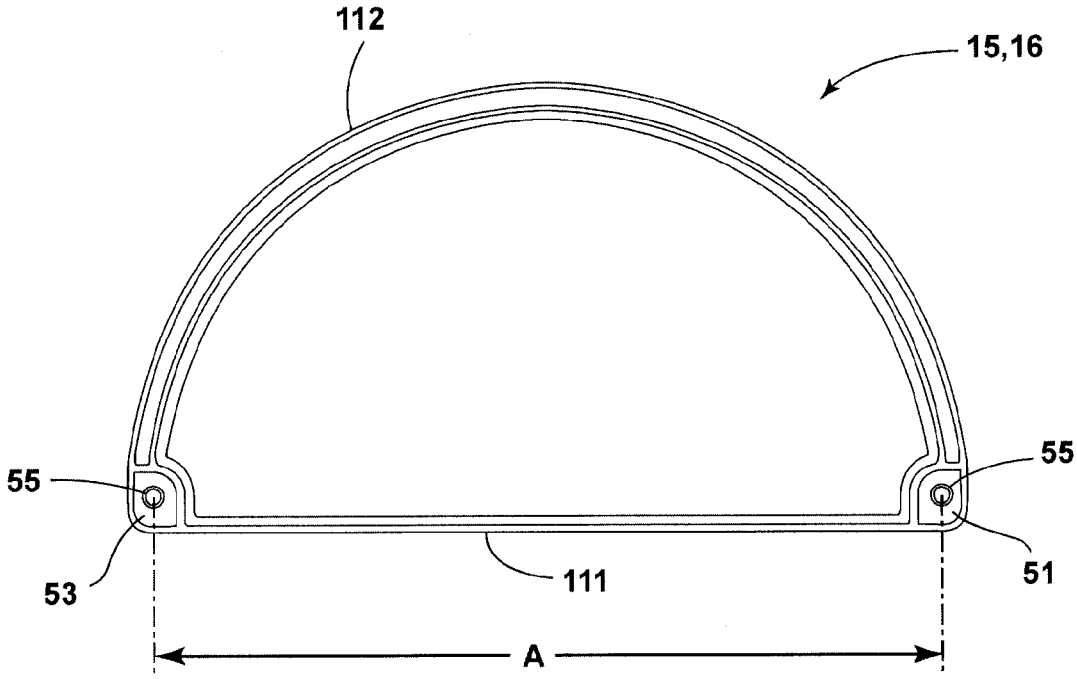
FIG. 9 is a top view of the end cap component of FIG. 8.
Figure 10:
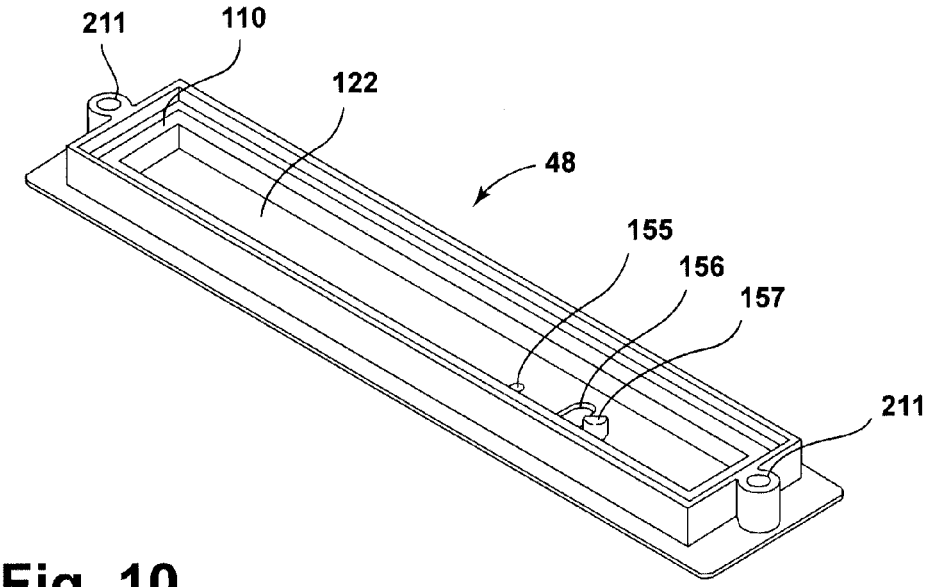
FIG. 10 is a perspective view of an LED circuit board housing component according to an illustrative embodiment.

In one illustrative embodiment shown in FIGS. 8 and 9, the first and second end caps 15, 16 may be identically shaped single piece components, as may the first and second end brackets 45, 47. The end caps 15, 16 each have a flat back surface 111, and a half cylindrical or arcuate surface 112 (FIGS. 8, 9). In one illustrative embodiment, dimension "A" may be, for example, eight inches. Such components 15, 16, 45, 47 may, for example, be diecast out of ZAMAK 3 or other suitable materials.

Each end bracket 45, 47 includes respective mounting blocks, e.g., 18, 20, 22, 24 onto which mount respective corner receptacles 51, 53 of the first and second end caps 15, 16. The respective bolts 17, 19, 21, 23 fit through suitable holes 55 in the corner receptacles 51, 53 and then through holes 57 in the mounting blocks 18, 20, 22, 24 to retain the end caps 15, 16 and lens cover 13 in position. The end brackets 45, 47 further have suitable holes 61 formed in flat mounting tabs or surfaces 63, 65. The flat surfaces 63, 65 may be placed against a wall and suitable fastening devices inserted therethrough to attach the sconce light 11 to a vertical or other wall surface.

Figure 6:
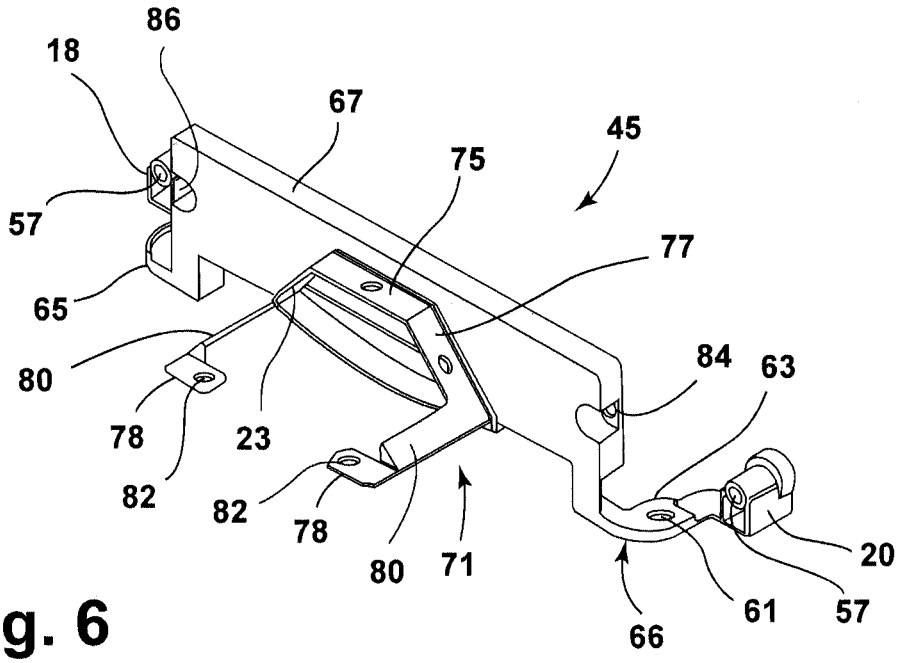
FIG. 6 is a perspective view of an end bracket component of the illustrative embodiments.
Figure 7:
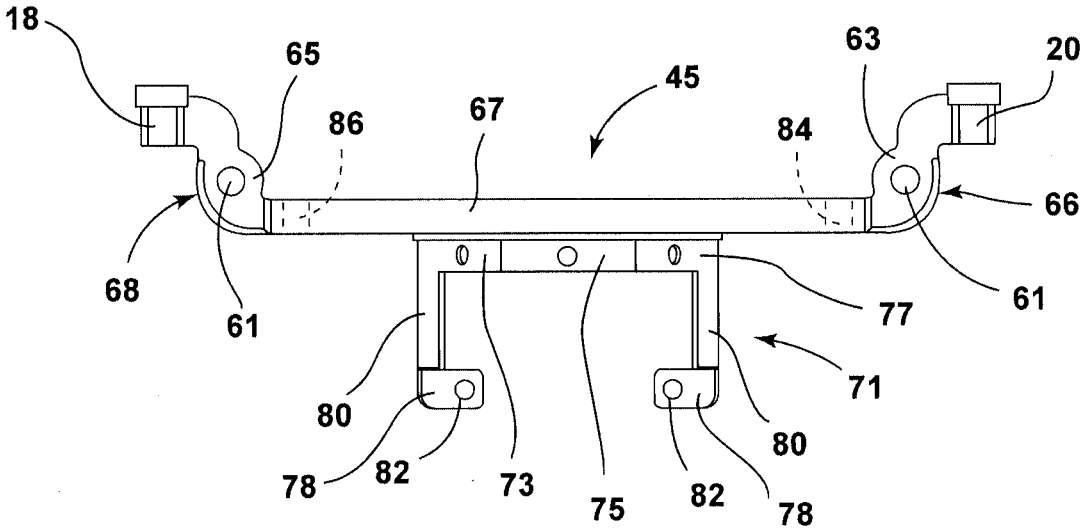
FIG. 7 is a top view of the end bracket component of FIG. 8.

As particularly illustrated in FIGS. 6 and 7, each end bracket 45, 47 further includes a central rectangular solid body portion 67 from which the flat surfaces 63, 65 and their attached mounting blocks 18, 20, 22, 24 project. The mounting blocks, e.g. 18, 20, are spaced away from the body portion 67 by respective arms 66, 68 which provide a 90 degree transition from the body 67 to the mounting blocks 18, 20.

A triangular support member 71 extends from one side surface of the central body 67. Each respective side surface 73, 75, 77 of the triangular support member 77 provides a surface to which a respective one of the rectangular LED housing components 48 may be attached. In one embodiment, the top flat surface 75 is horizontal and each of the side surfaces 73, 77 is disposed at an acute angle of, for example, 50 degrees to the horizontal. This arrangement facilitates positioning the LED housing components 48 so as to achieve uniform distribution of LED-generated light around the arc of the sconce light lens 13.

Flat tabs 78 with respective holes 82 therein are formed on vertical legs 80 of the mounting bracket 45, which legs 80 extend from the lower ends of the respective sides 73, 77 of the triangular support component 71. In one single bank embodiment as shown on FIG. 5, the junction box bracket 31 and junction box component 32 are attached by fastening devices passing through suitable holes or apertures therein and then through the holes 82 of the upper and lower mounting brackets 45, 47. The up and down light housing components 49, 50 are attached to the body portions 67 of upper and lower mounting brackets 45, 47 by fasteners inserted the through respective holes 111, 84, 86.

Figure 14:
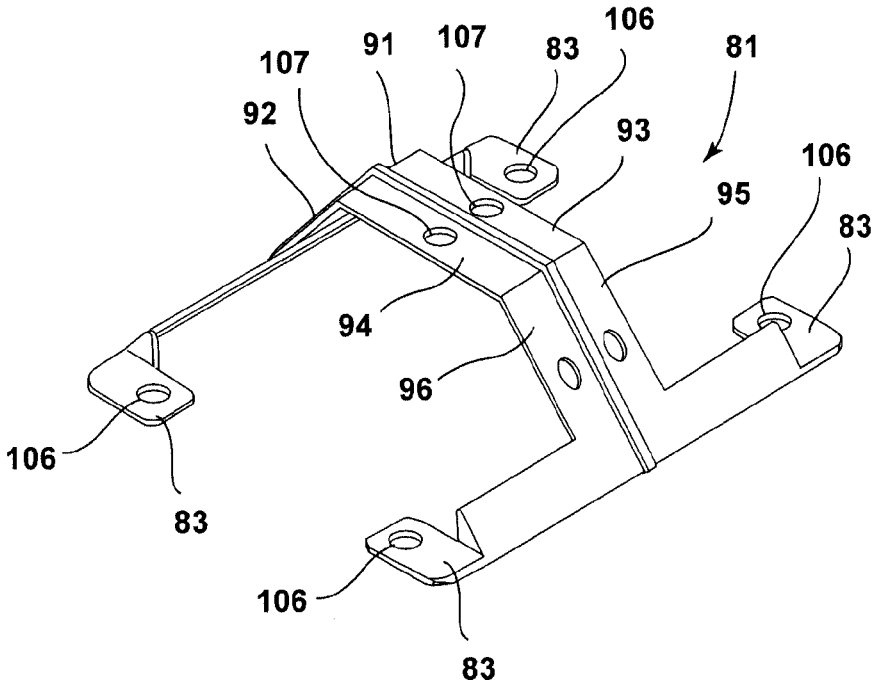
FIG. 14 is a perspective view of an expansion bracket component according to an illustrative embodiment.
Figure 15:
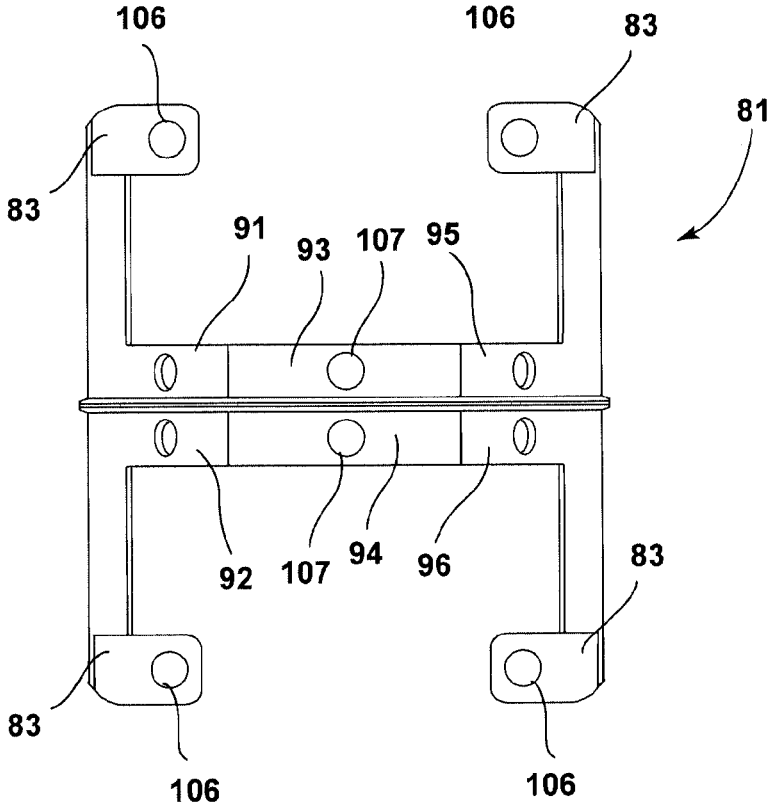
FIG. 15 is a top view of the expansion bracket component of FIG. 14.
Figure 16:
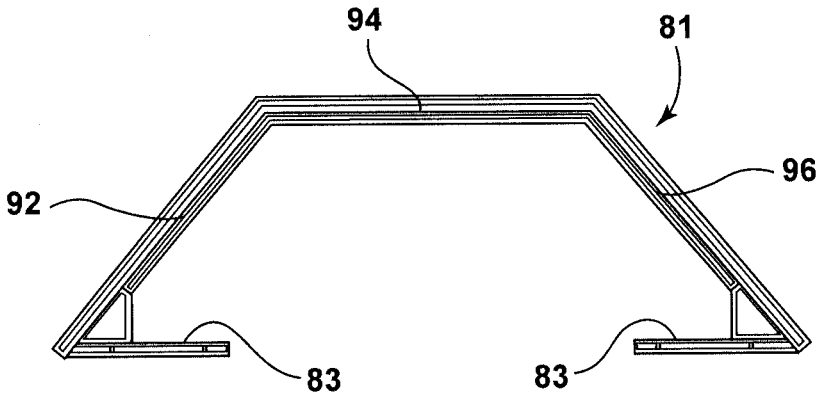
FIG. 16 is an end view of the expansion bracket component of FIGS. 14 and 15.
Figure 17:
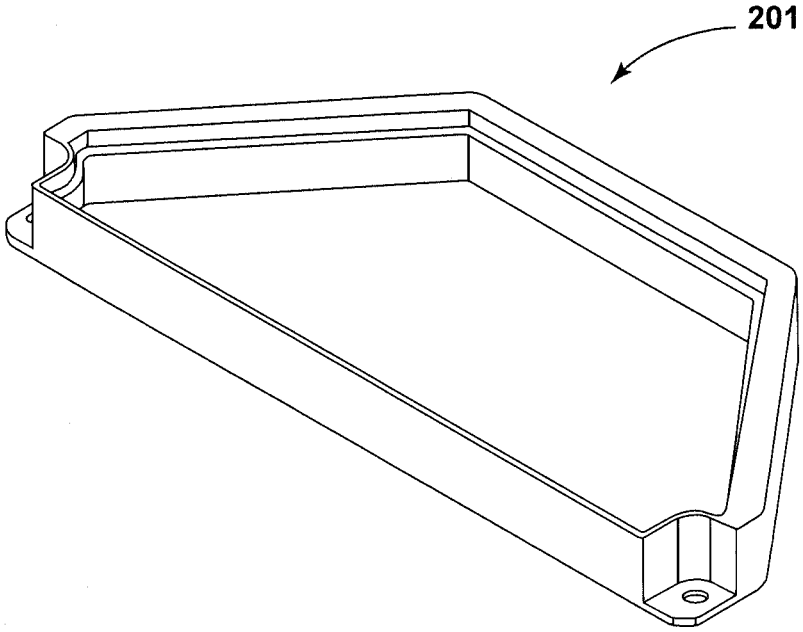
FIG. 17 is a perspective view of an alternate end cap embodiment.

It will be noted that the sconce light embodiment shown in FIG. 5 includes a first bank 101 of three rectangular LED lamp housing components, each attached to respective sides 73, 75, 77 of the opposing end brackets 45, 47. As reflected in the embodiment of FIGS. 1-3, the length of the sconce light is expandable by adding a second bank 103 of triangularly arranged or arrayed LED lamp housing components 48. To facilitate this expandable arrangement, a module connector or expansion bracket 81 is provided, an illustrative embodiment of which is shown in FIGS. 14-16.

As may be seen, this expansion bracket 81 provides upper top and side mounting surfaces 91, 93, 95 and lower top and side mounting surfaces 92, 94, 96 with the lower surfaces shaped identically to the upper surfaces and respectively lying adjacent to one another. Suitable mounting tabs or feet 83 and holes 106 are provided to facilitate attachment of the junction box bracket 31 and junction box 32 in the embodiment of FIGS. 1-3. Thus, in the embodiment of FIGS. 1-3, the lower ends of the upper bank 101 of LED housing components 48 are respectively attached or fastened to respective upper mounting surfaces 91, 93, 95, while the upper ends of the lower banks 103 of LED housing components 48 are respectively attached to respective lower mounting surfaces 92, 94, 96. By employing a second expansion bracket 81, a sconce light embodiment with three vertically disposed banks of LED light housing components 48 may be configured to achieve a still longer sconce unit. Thus, the illustrative embodiment is modular and expandable.

In one illustrative embodiment, the lens cover 13 may be constructed of 0.1" minimum thickness impact resistant DR acrylic in a half cylindrical form. Standard lens forms or patterns may include polished smooth and medium fluted patterns. In one embodiment, the lens cover 13 may be capable of retaining up to two colored gels and/or patterned films mounted internal to the luminaire. Using colored gels behind the lens cover, e.g., 13, avoiding the need for colored LEDs. Lens covers 13 may also have different shapes in different embodiments, for example, an ADA compliant polygonal lens shape wherein polygonal shaped end caps 201 such as shown in FIG. 16 are used in place of the arcuate end caps 15, 16.

In various embodiments, the LEDs utilized may be lighting class rated for a maximum drive current of 500 mA with a minimum CRI rating of 80 or greater and may comprise, for example, Cree ⅓ or ½ watt units, employing, for example, 3 LEDs on a 6 inch board. The illustrative embodiment may further employ an LED driver 202 (FIG. 5) integral to the unit and preferably having a power factor no less than 95% with maximum total harmonic distortion of <10. In one embodiment, the driver 202 is rated for no less than 50,000 hours of life when operated in a 25° C. environment. The driver 202 may be mounted to the underside of one of the housing components 48, for example, using double sided tape with power supplied to it, for example, by wires passing through an opening in the junction box bracket 31.

In various embodiments, the length of central lighting platform may be extended, for example, from 9 inches in an illustrative embodiment of FIG. 5 to 15 inches in an illustrative embodiment of FIGS. 1-3 to 21 inches or longer by adding additional banks of LED housing components as discussed above. Such extension permits accommodating various wall heights encountered, for example, along a descending aisle way, as may be found, for example, in movie theaters.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. An LED light fixture comprising:

a contoured light transmissive lens cover;

upper and lower end brackets, each having respective right and left mounting blocks and respective support members extending therefrom;

upper and lower end caps each having a flat linear back surface and a contoured surface shaped to match the contour of the contoured lens cover, the upper end cap being attached to the right and left mounting blocks of the upper mounting bracket, the lower end cap being attached to the right and left mounting blocks of the lower mounting bracket;

the lens cover being pivotally mounted so as to be movable between an open position and a closed position wherein in the closed position an upper and lower contoured edge of the lens cover mate flushly with the contoured surface of the respective upper and lower end caps; and a plurality of LED housing components, each carrying a circuit board comprising at least one LED, each housing component attached to the support member of one of said upper and lower mounting brackets such that said housing components are positioned behind said lens cover when said lens cover is closed and so as to direct illumination toward said lens cover.

2. The LED light fixture of claim 1 wherein the plurality of LED housing components comprise a first, second, and third LED housing component arrayed in a first bank in a triangular configuration.

3. The LED light fixture of claim 2 wherein the lens cover is semicircular in cross-section.

4. An LED light fixture apparatus comprising:

a contoured light transmissive lens cover;

upper and lower end brackets, each having respective right and left mounting blocks and respective support members extending therefrom;

upper and lower end caps each having a flat linear back surface and a contoured surface shaped to match the contour of the contoured lens cover, the upper end cap being attached to the right and left mounting blocks of the upper mounting bracket, the lower end cap being attached to the right and left mounting blocks of the lower mounting bracket;

the lens cover being pivotally mountable between the upper and lower end caps so as to be movable between an open position and a closed position wherein in the closed position an upper and lower contoured edge of the lens cover mate flushly with the contoured surface of the respective upper and lower end caps;

a first bank comprising a first plurality of LED housing components, each carrying a circuit board comprising at least one LED, each housing component attached to the support member of said upper mounting bracket such that said housing components are positioned behind said lens cover when said lens cover is closed and so as to direct illumination toward said lens cover;

a second bank comprising a second plurality of LED housing components, each carrying a circuit board comprising at least one LED, each housing component attached to the support member of said lower mounting bracket such that said housing components are positioned behind said lens cover when said lens cover is closed and so as to direct illumination toward said lens cover, said second bank being positioned below said first bank; and an expansion bracket to which respective lower and upper ends of the respective LED housing components of the first and second bank of LED lamp housing components are attached.

5. The LED light fixture apparatus of claim 4 wherein the first plurality of LED housing components comprises a first, second, and third LED housing component arrayed in the first bank in a triangular configuration.

6. The LED light fixture apparatus of claim 5 wherein the lens cover is semicircular in cross-section.

* * * * *